US008307879B2

(12) United States Patent
Lin

(10) Patent No.: US 8,307,879 B2
(45) Date of Patent: Nov. 13, 2012

(54) WINDOW COVERING HAVING A WINDING FUNCTION

(75) Inventor: Paul Lin, Tainan Hsien (TW)

(73) Assignee: Macauto Industrial Co., Ltd., Tainan Hsien (TW)

( * ) Notice: Subject to any disclaimer, the term of this patent is extended or adjusted under 35 U.S.C. 154(b) by 135 days.

(21) Appl. No.: 12/754,950

(22) Filed: Apr. 6, 2010

(65) Prior Publication Data

US 2011/0240235 A1 Oct. 6, 2011

(51) Int. Cl.

| | |
|---|---|
| ***E06B 9/56*** | (2006.01) |
| ***A47G 5/02*** | (2006.01) |
| ***A47H 1/00*** | (2006.01) |

(52) U.S. Cl. ..... 160/314; 160/313

(58) Field of Classification Search ..... 160/191, 160/192, 305, 313, 314, 315, 323.1, 370.22, 160/170

See application file for complete search history.

(56) References Cited

U.S. PATENT DOCUMENTS

| | | | | |
|---|---|---|---|---|
| 5,934,354 | A * | 8/1999 | Price et al. | 160/370.22 |
| 6,131,642 | A * | 10/2000 | Welfonder | 160/301 |
| 6,655,441 | B2 * | 12/2003 | Wen et al. | 160/168.1 P |
| 7,694,712 | B2 * | 4/2010 | Schimko et al. | 160/315 |
| 7,874,343 | B2 * | 1/2011 | Hansen | 160/370.22 |
| 2009/0283226 | A1 * | 11/2009 | Cheng | 160/313 |

* cited by examiner

*Primary Examiner* — Katherine W Mitchell
*Assistant Examiner* — Jeremy Ramsey
(74) *Attorney, Agent, or Firm* — Pillsbury Winthrop Shaw Pittman, LLP

(57) ABSTRACT

A window covering includes a mounting unit, a shading unit, and a winding unit. The mounting unit includes a first fixing member and a second fixing member. The shading unit includes a rotating axle, a curtain member fixed at one end to the rotating axle and which is wound on and unwound from the rotating axle, a first rotating member, and a second rotating member. The first rotating member and the second rotating member are fixed to the rotating axle and extend respectively through the first fixing member and the second fixing member to support rotation of the rotating axle therebetween. The winding unit is mounted to the first fixing member and includes a spring reel secured to the first rotating member to rotate therewith, an auxiliary wheel, and a spring wound around the auxiliary wheel and which is fixed at one end to the spring reel.

2 Claims, 5 Drawing Sheets

WINDOW COVERING HAVING A WINDING FUNCTION

BACKGROUND OF THE INVENTION

1. Field of the Invention

The present invention relates to a winding covering, more particularly to a winding covering having a winding function.

2. Description of the Related Art

Referring to FIGS. 1 and 2, a conventional window covering 1 includes two fixing members 11 that are spaced apart from each other, a case 12 that is mounted between the fixing members 11, a shading unit 13 that is disposed rotatably between the fixing members 11, and a winding unit 19.

The shading unit 13 includes a rotating axle 131 that is inserted into a cavity 121 of the case 12, a curtain member 132 that is wound around the rotating axle 131 and is able to be unwound therefrom by passing through an insertion groove 122 of the case 12, a grip component 133 that is mounted on an end portion of the curtain member 132, and two rotating members 134 that are mounted respectively to two end portions of the rotating axle 131. The winding unit 19 includes an axle 141 that is inserted into a passage 135 of the rotating axle 131 and is fixed to one of the fixing members 11, and a spring 192 that surrounds and is connected at one end to the axle 141 and at its other end to one of the rotating members 134, that is, the rotating member 134 adjacent to the fixing member 11 to which the axle 141 is fixed.

When the curtain member 132 is unwound from the rotating axle 131 by pulling the grip component 133, the rotating axle 131, which is rotated by such action, in turn rotates the rotating members 134. As a result, the spring 142 is subsequently twisted to thereby store a restoring force. The restoring force is used in restoring the rotating axle 131 and the rotating members 134 to their original positions when the curtain member 132 is released, such that the curtain member 132 can be again wound around the rotating axle 131.

The axle 141 and the spring 142 are mounted in the passage 135 of the rotating axle 131. Therefore, these elements encounter limitations due to the insufficient space provided by the passage 135. For example, the size of the spring 142 is limited and as a result, it is not possible to provide a greater restoring force to the rotating axle 131, the rotating members 134, and the curtain member 132. Similarly, other components of the winding unit 14 cannot be increased in size, and hence, it is difficult to assemble the winding unit 14 or replace any of the components thereof.

SUMMARY OF THE INVENTION

Therefore, the object of the present invention is to provide a window covering which is easy to assemble, in which spring thereof may be varied in size as needed, and in which components of a winding unit may be easily replaced.

Accordingly, a window covering of the present invention comprises a mounting unit, a shading unit, and a winding unit.

The mounting unit includes a first fixing member and a second fixing member that are spaced apart from each other.

The shading unit includes a rotating axle, a curtain member, a first rotating member, and a second rotating member. The curtain member is fixed at one end to the rotating axle and is wound on and unwound from the rotating axle. The first rotating member and the second rotating member are fixed to the rotating axle and extend respectively through the first fixing member and the second fixing member to support rotation of the rotating axle therebetween.

The winding unit is mounted to the first fixing member and includes a spring reel, an auxiliary wheel, and a spring. The spring reel is secured to the first rotating member to rotate therewith. The spring is wound around the auxiliary wheel, and is fixed at one end to the spring reel.

When the curtain member is unwound from the rotating axle, the first rotating member rotates the spring reel such that the spring is unwound from the auxiliary wheel and wound around the spring reel to store a restoring force. The restoring force is used in restoring the spring reel, the first rotating member, and the rotating axle to their original positions when the curtain member is released.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
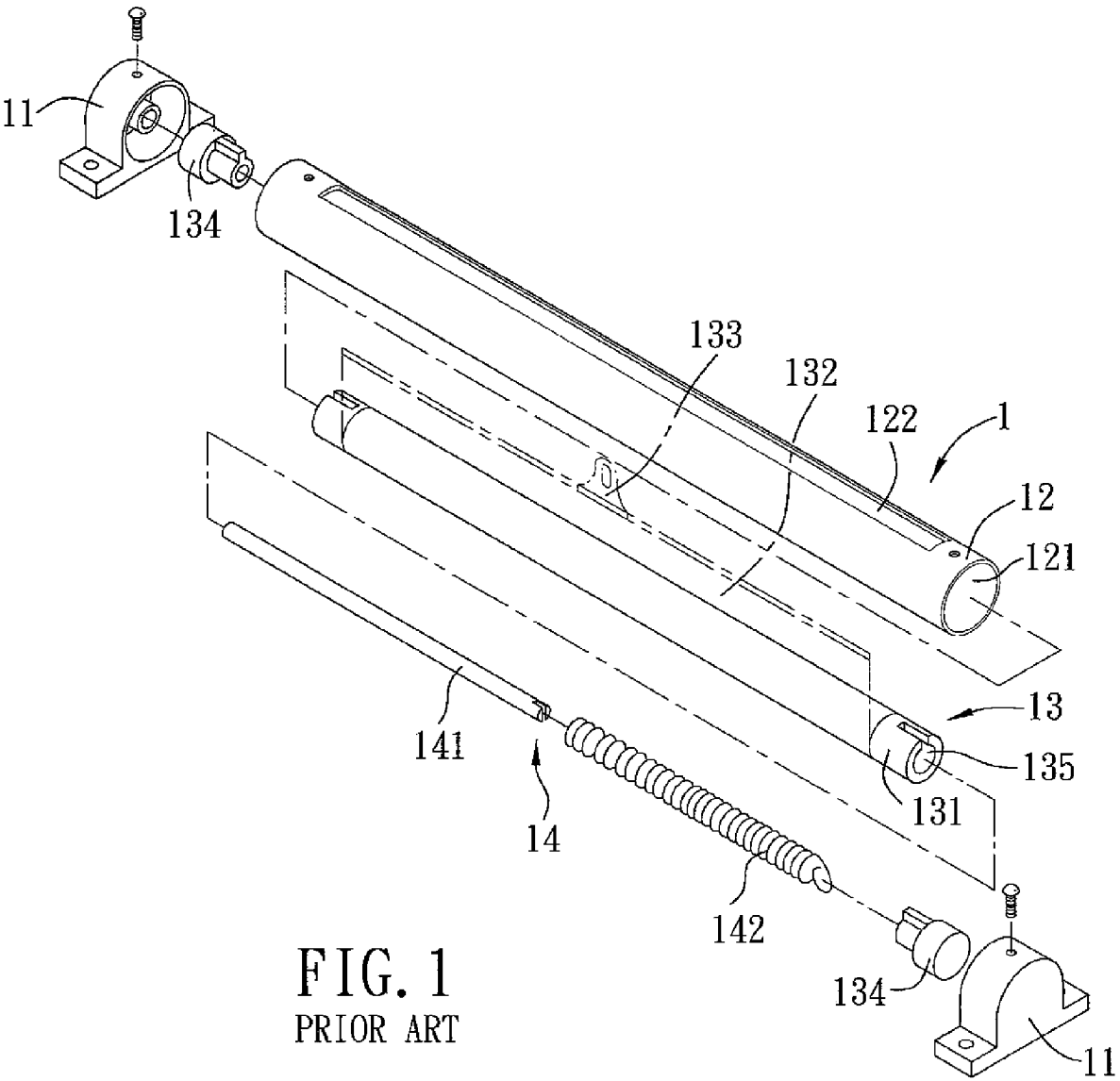
FIG. 1 PRIOR ART
FIG. 1 is an exploded perspective view of a conventional window covering.
Figure 2:
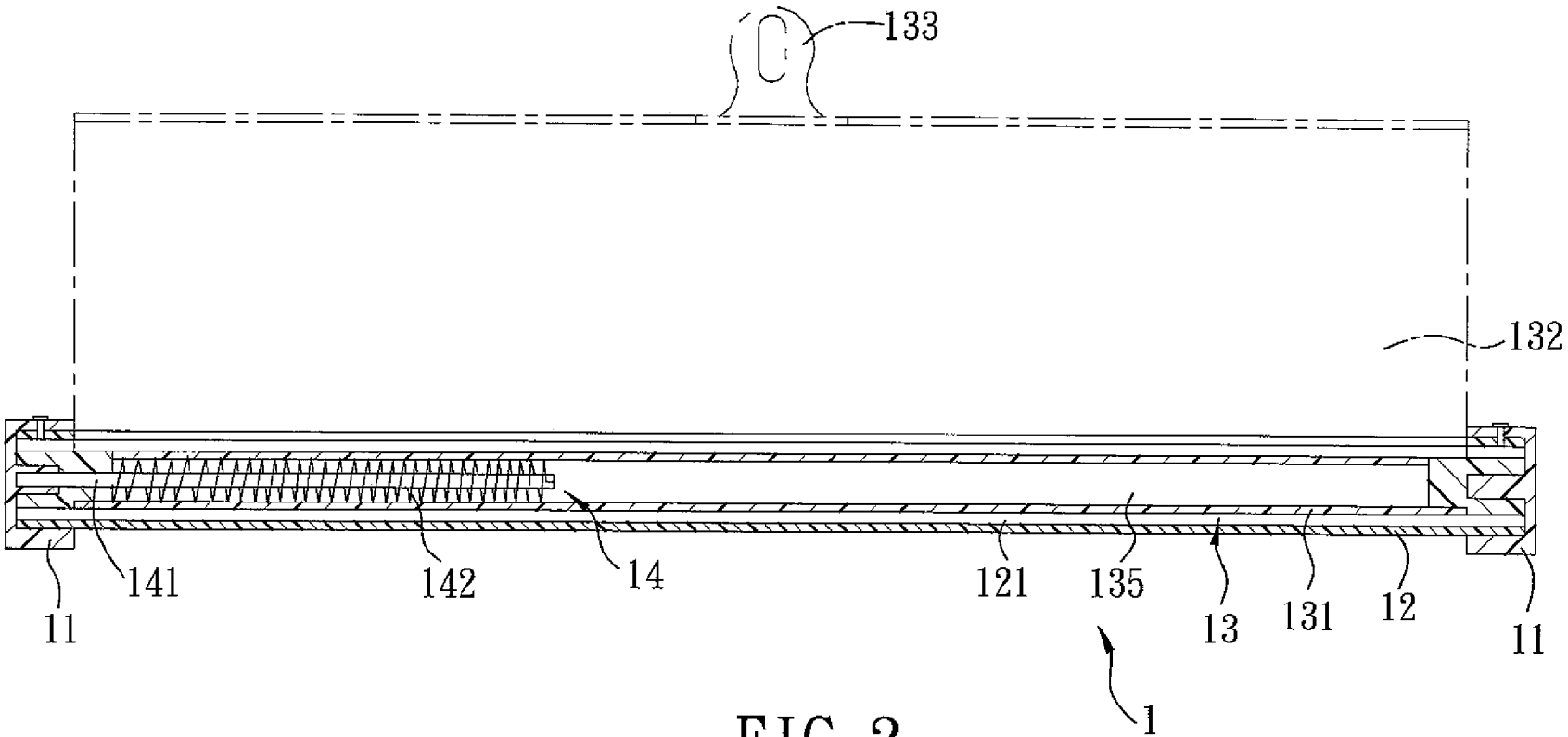
FIG. 2 PRIOR ART
FIG. 2 is a sectional view of the conventional window covering of FIG. 1.
Figure 3:
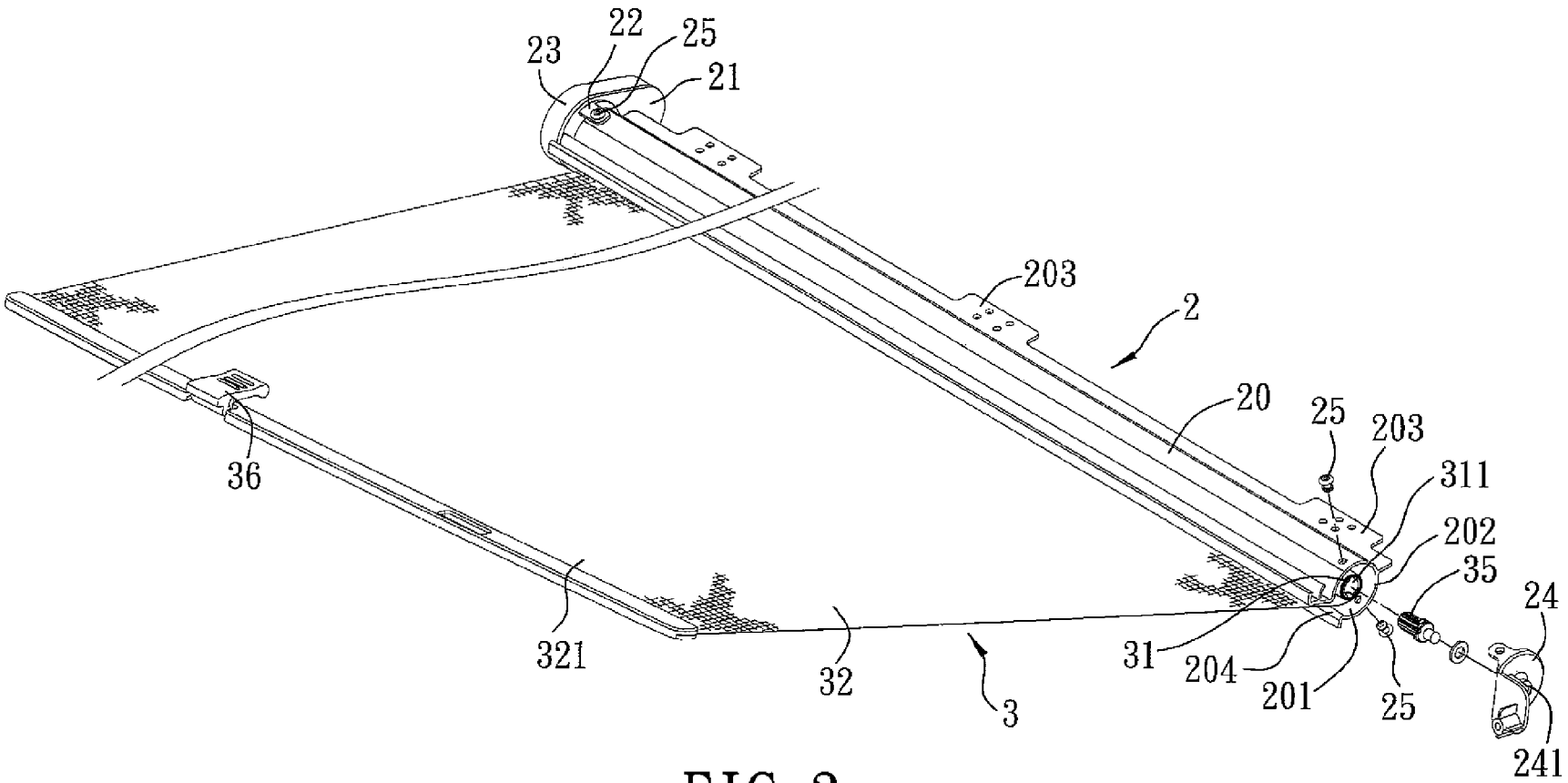
FIG. 3 is a fragmentary exploded perspective view of a window covering according to a preferred embodiment of the present invention, illustrating a state in which a curtain member of the window covering is unwound.
Figure 4:
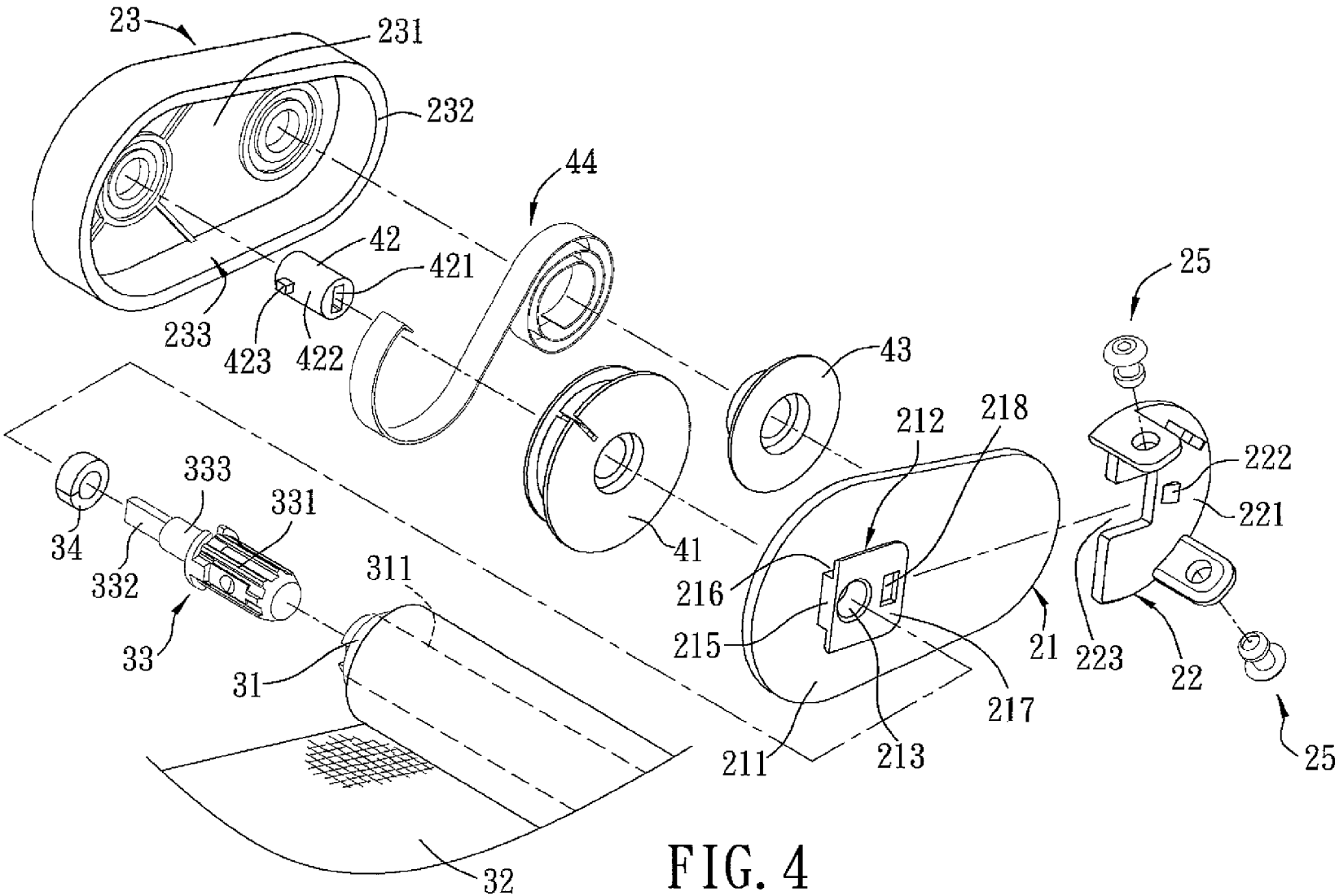
FIG. 4 is a fragmentary exploded perspective view of the window covering of the preferred embodiment.
Figure 5:
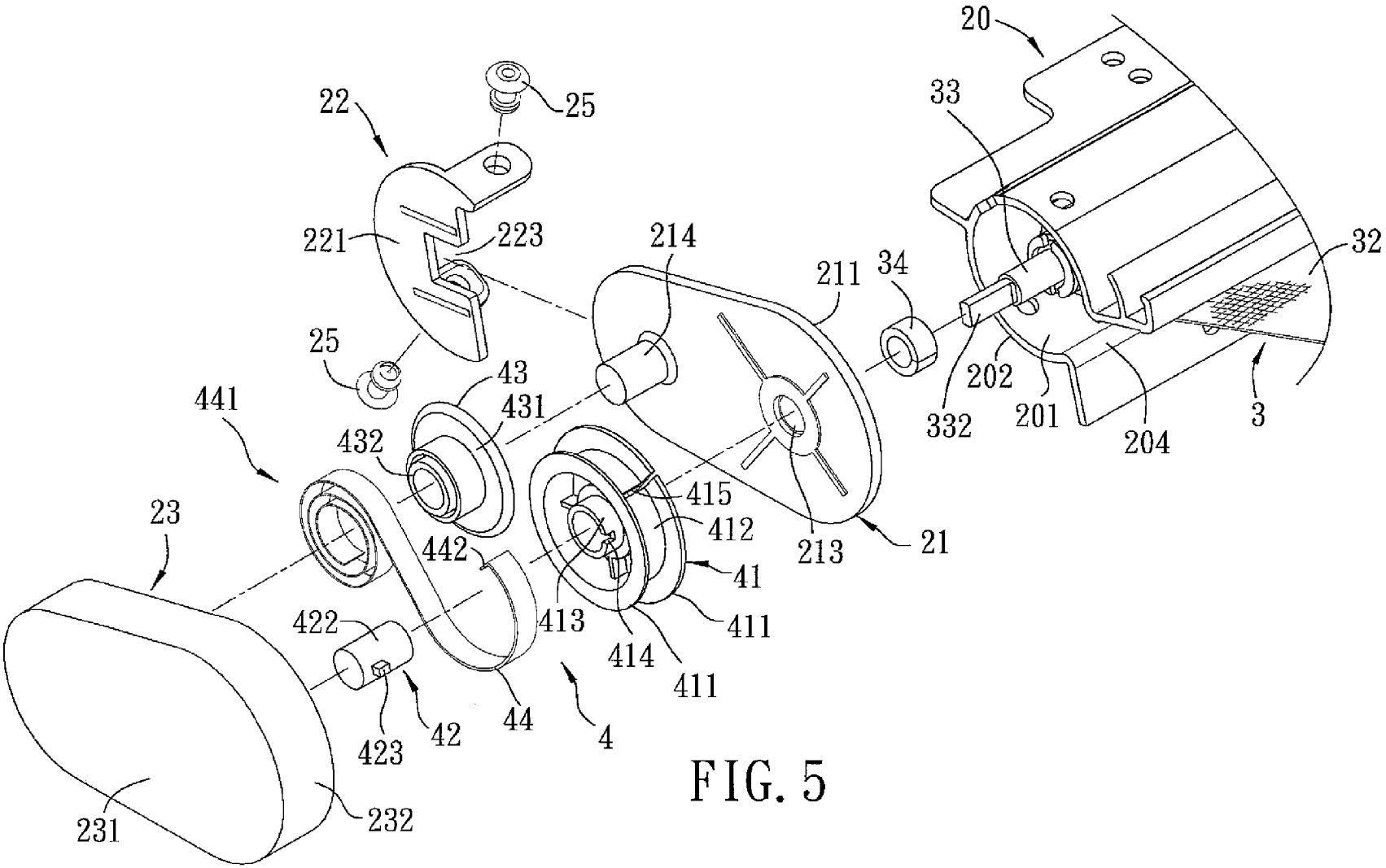
FIG. 5 is another fragmentary exploded perspective view of the window covering of the preferred embodiment.

Referring to FIGS. 3, 4, and 5, a preferred embodiment of a window covering according to the present invention is adapted for being mounted to a window (not shown). As an example, the window covering may be mounted to a window of a vehicle. The window covering comprises a mounting unit 2, a shading unit 3, and a winding unit 4.

The mounting unit 2 includes a first fixing member 21, a second fixing member 24, a case 20, a connecting seat 22, a cover 23, and four fasteners 25.

The first fixing member 21 and the second fixing member 24 are spaced apart from each other. The case 20 is disposed between the first fixing member 21 and the second fixing member 24. The connecting seat 22 interconnects the case 20 and the first fixing member 21.

The first fixing member 21 includes a side wall 211, a securing portion 212, and a mounting rod 214. The side wall 211 is formed with a rotating hole 213. The securing portion 212 is disposed on the side wall 211, and is also formed with the rotating hole 213. The mounting rod 214 extends from an outer surface of the side wall 211. In this embodiment, the securing portion 212 is formed on an inner face of the side wall 211 and the mounting rod 214 is formed extending from an outer face of the side wall 211.

The securing portion 212 has a base 215 that is connected to the side wall 211, and a clamp 217 that is connected to the base 215 and cooperates with the side wall 211 to define a clamping groove 216. The clamp 217 has a clamping hole 218.

The case 20 has a surrounding wall 202 and a plurality of fixing walls 203. The surrounding wall 202 defines a passage 201 and is open at one side thereof to further define a groove 204. The fixing walls 203 extend from the surrounding wall 202.

The connecting seat 22 is mounted to one of two ends of the case 20 using two of the fasteners 25. The connecting seat 22 has a seat wall 221 that is partially received in the clamping groove 216, and a seat protrusion 222 that is disposed on the seat wall 221 and engages the clamping hole 218. The seat wall 221 has an engaging indentation 223 that is formed such that the seat wall 221 surrounds the base 215 of the securing portion 212.

The cover 23 is disposed on a side of the side wall 211 of the first fixing member 21 on which the winding unit 4 is disposed (i.e., adjacent to the outer face of the side wall 211), and has an outer cover wall 231 and a surrounding cover wall 232. The outer cover wall 231 is spaced apart from the side wall 211 and matches the shape of the side wall 211. The surrounding cover wall 232 surrounds an outer periphery of the outer cover wall 231 and extends toward the side wall 211. The surrounding cover wall 232 and the outer cover wall 231 define an accommodation space 233 in which the winding unit 4 is disposed.

The second fixing member 24 is mounted to the other one of the two ends of the case 20 (i.e., opposite the end to which the connecting seat 22 is mounted) using the other two of the fasteners 25. The second fixing member 24 has a pivoting hole 241 that is aligned substantially with the rotating hole 213 in the side wall 211 of the first fixing member 21.

The shading unit 3 includes a rotating axle 31, a curtain member 32, a first rotating member 33, a second rotating member 35, a sleeving ring 34, and a grip component 36.

The rotating axle 31 is at least partially inserted into the passage 201 of the case 20. The curtain member 32 is fixed at one end to the rotating axle 31 and is wound on and unwound from the rotating axle 31. The first rotating member 33 and the second rotating member 35 are fixed to the rotating axle 31 and extend respectively through the rotating hole 213 of the first fixing member 21 and the pivoting hole 241 of the second fixing member to support rotation of the rotating axle 31 therebetween.

The curtain member 32 has an end portion 321 that is operable to extend outwardly from the groove 204 of the surrounding wall 202 of the case 20. The grip component 36 is mounted to the end portion 321 of the curtain member 32.

The first rotating member 33 includes a pillar portion 332, a joining portion 331, and a rotating portion 333. The pillar portion 332 extends through the rotating hole 213 of the first fixing member 21. The joining portion 331 is fixedly mounted to the rotating axle 31. In this embodiment, the joining portion 331 is inserted into an axial passage 311 of the rotating axle 31 and is secured therein, such as by having a diameter that is slightly smaller than the size of the axial passage 311. The rotating portion 333 is disposed between the joining portion 331 and the pillar portion 332. In this embodiment, a cross section of the pillar portion 332 is rectangular.

The sleeving ring 34 is sleeved on the rotating portion 333 of the first rotating member 33 and is mounted in the rotating hole 213 of the first fixing member 21.

The winding unit 4 is mounted to the first fixing member 21, and includes a spring reel 41, an auxiliary wheel 43, and a spring 44. The spring reel 41 is secured to the first rotating member 33 to rotate therewith, and is disposed between the side wall 211 and the outer cover wall 231. The auxiliary wheel 43 is sleeved rotatably on the mounting rod 214 of the first fixing member 21. The spring 44 is wound around the auxiliary wheel 43, and is fixed at one end to the spring reel (this will be described in greater detail below). The winding unit 4 further includes a seat 42 that is operable to rotate the spring reel 41 as the first rotating member 33 rotates, and in which the first rotating member 33 is securely received, such that the seat 42 moves in unison with the first rotating member 33. The spring reel 41 includes two wheel walls 411, a surrounding wall 412, and a tube wall 413. The wheel walls 411 are spaced horizontally apart from each other. The surrounding wall 412 interconnects the wheel walls 411, surrounds the first rotating member 33, and has an insertion groove 415. The spring 44 is wound around the surrounding wall 412 when the curtain member 32 is unwound from the rotating axle 31. The tube wall 413 extends from the inner one of the wheel walls 411 and is surrounded by the surrounding wall 412, and a distal end portion of the tube wall 413 is formed with an indentation 414.

The auxiliary wheel 43 has a base wall 431, and a tube wall 432 protruding from the base wall 431 and for extension of the mounting rod 214 of the first fixing member 21 therethrough.

The spring 44 includes a winding end segment 441 and a hook end 442. The winding end segment 441 is wound around the tube wall 432 of the auxiliary wheel 43. The hook end 442 is inserted into the insertion groove 415 of the spring reel 41.

The seat 42 has a cylindrical body 422 and a protrusion 423. An end portion of the cylindrical body 422 is formed with an insertion groove 421 into which the pillar portion 332 of the first rotating member 33 is inserted. The protrusion 423 is disposed on a surface of the cylindrical body 422, and is received in the indentation 414 of the tube wall 413 of the spring reel 41.

When the curtain member 32 is wound around the rotating axle 31, most of the spring 44 is wound around the tube wall 432 of the auxiliary wheel 43.

As shown in FIG. 3, when the curtain member 32 is unwound from the rotating axle 31 by holding the grip component 36 and pulling in a direction away from the case 20 of the mounting unit 2, the rotating axle 31 drives the first and second rotating members 33, 35 to rotate, and the first rotating member 33, in turn, drives the seat 42 and therefore the spring reel 41 to rotate such that the spring 44 is unwound from the tube wall 432 of the auxiliary wheel 93 and wound around the spring reel 41 to store a restoring force. If desired, the grip component 36 may be releasably connected to an external component (not shown) to thereby maintain the curtain member 32 in an unwound state.

The restoring force is used in restoring the spring reel 41, the seat 42, the first rotating member 33, the second rotating member 35, and the rotating axle 31 to their original positions when the curtain member 32 is released, such that the curtain member 32 can be wound automatically.

It is noted that the winding unit 4 is mounted to an outer side of the first fixing member 21 of the mounting unit 2 (i.e., adjacent to the outer face of the side wall 211) so the winding unit 4 can neither occupy any internal space in the shading unit 3 nor hinder the rotation of the rotating axle 31. Therefore, the present invention is easy to assemble and disassemble. Moreover, the size of the spring 44 may be varied as needed so that, for example, a greater restoring force can be provided. Finally, the spring 44 and any of the other components of the winding unit 4 may be easily replaced.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A window covering having a winding function comprising:

a mounting unit including a first fixing member and a second fixing member that are spaced apart from each other;

a shading unit including a rotating axle, a curtain member that is fixed at one end to said rotating axle and that is wound on and unwound from said rotating axle, a first rotating member, and a second rotating member, said first rotating member and said second rotating member being fixed to said rotating axle and extending respectively through said first fixing member and said second fixing member to support rotation of said rotating axle therebetween; and a winding unit mounted to said first fixing member and including a spring reel secured to said first rotating member to rotate therewith, an auxiliary wheel, and a spring that is wound around said auxiliary wheel, and that is fixed at one end to said spring reel;

wherein said first rotating member includes a pillar portion, said winding unit including a seat in which said pillar portion of said first rotating member is securely received such that said seat moves in unison with said first rotating member, said seat having a protrusion, said spring reel of said winding unit having an indentation in which said protrusion is received;

wherein said first fixing member includes a side wall that is formed with a rotating hole for extension of said pillar portion of said first rotating member therethrough, and a mounting rod that extends from said side wall and on which said auxiliary wheel is mounted;

wherein said spring reel includes a surrounding wall around which said spring is wound when said curtain member is unwound from said rotating axle, and that has an insertion groove;

wherein said spring includes a winding end segment that is wound around said auxiliary wheel, and a hook end that is inserted into said insertion groove of said spring reel;

wherein said mounting unit further includes a case disposed between said first and said second fixing member members, and a connecting seat that interconnects said case and said first fixing member, said first fixing member further including a securing portion disposed on said side wall and engaging said connecting seat, said connecting seat having a seat wall in the form of a plate that is attached transversely to said case between one end of said case and said side wall of said first fixing member, said seat wall having an engaging indentation engaged to said securing portion and aligned with said rotating hole, said pillar portion of said first rotating member extending through said rotating hole and said engaging indentation into said seat; and wherein when said curtain member is unwound from said rotating axle, said first rotating member rotates said spring reel such that said spring is unwound from said auxiliary wheel and wound around said spring reel to store a restoring force, the restoring force being used in restoring said spring reel, said first rotating member, and said rotating axle to their original positions when said curtain member is released.

2. The window covering as claimed in claim 1, wherein said securing portion includes a base that is connected to said side wall, and a clamp having a plate that is connected to said base and that is spaced apart from said side wall, said side wall and said plate of said clamp cooperatively defining therebetween a clamping groove, said clamping groove surrounding said base, said seat wall of said connecting seat being engaged to said clamping groove, said clamp having a clamping hole, said connecting seat further having a seat protrusion projecting from said seat wall and engaged to said clamping hole.

* * * * *